US008985357B1

(12) United States Patent
Strayer et al.

(10) Patent No.: US 8,985,357 B1
(45) Date of Patent: Mar. 24, 2015

(54) FLUID DELIVERY DEVICE

(71) Applicants: Todd Strayer, Maumee, OH (US); Bobbie Strayer, Maumee, OH (US)

(72) Inventors: Todd Strayer, Maumee, OH (US); Bobbie Strayer, Maumee, OH (US)

(73) Assignee: GMS Medical LLC, Holland, OH (US)

( * ) Notice: Subject to any disclaimer, the term of this patent is extended or adjusted under 35 U.S.C. 154(b) by 0 days.

(21) Appl. No.: 13/921,656

(22) Filed: Jun. 19, 2013

Related U.S. Application Data

(60) Provisional application No. 61/661,647, filed on Jun. 19, 2012.

(51) Int. Cl.
*A61J 9/00* (2006.01)
*A61J 7/00* (2006.01)

(52) U.S. Cl.
CPC ..... *A61J 7/0053* (2013.01)
USPC ..... 215/11.1; 604/218

(58) Field of Classification Search
CPC ..... A61J 7/0053; A61J 7/0046; A61J 9/00; A61J 11/0005; A61J 11/00; A61M 3/00
USPC ..... 215/11.1; 604/11
See application file for complete search history.

(56) References Cited

U.S. PATENT DOCUMENTS

| | | | | |
|---|---|---|---|---|
| 1,545,436 | A | 7/1925 | McGeary | |
| 4,184,367 | A * | 1/1980 | Jenney et al. | 73/37 |
| 4,821,895 | A * | 4/1989 | Roskilly | 215/11.1 |
| 4,923,096 | A * | 5/1990 | Ennis, III | 222/391 |
| 5,029,701 | A * | 7/1991 | Roth et al. | 206/232 |
| 5,114,374 | A | 5/1992 | Estiva | |
| 5,244,122 | A | 9/1993 | Botts | |
| 5,300,024 | A * | 4/1994 | Yang | 604/73 |
| 5,354,274 | A | 10/1994 | Demeter et al. | |
| 5,383,906 | A * | 1/1995 | Burchett et al. | 606/236 |
| 5,431,680 | A | 7/1995 | Jones | |
| 5,512,047 | A | 4/1996 | Dvorak | |
| 5,620,462 | A | 4/1997 | Valenti | |
| 5,662,684 | A | 9/1997 | Caso | |
| 5,728,137 | A | 3/1998 | Anderson-Fignon | |
| 5,772,685 | A | 6/1998 | Crowe et al. | |
| 5,810,886 | A | 9/1998 | Hassan | |
| 5,843,030 | A * | 12/1998 | Van Der Merwe | 604/77 |
| 5,891,165 | A | 4/1999 | Buckner | |
| 5,932,262 | A | 8/1999 | Little | |
| 6,110,193 | A * | 8/2000 | Chen | 606/234 |
| 6,139,566 | A | 10/2000 | Bennett | |
| 6,270,519 | B1 * | 8/2001 | Botts | 606/236 |
| 6,454,788 | B1 | 9/2002 | Ashton | |
| 6,547,808 | B2 | 4/2003 | Tuckey et al. | |
| 7,320,678 | B2 * | 1/2008 | Ruth et al. | 604/77 |
| 7,753,886 | B2 | 7/2010 | Vath et al. | |
| 8,141,551 | B2 * | 3/2012 | Wachter | 128/200.18 |
| 2006/0079814 | A1 * | 4/2006 | Barlow et al. | 600/590 |
| 2008/0196716 | A1 * | 8/2008 | Wachter | 128/203.12 |
| 2008/0223807 | A1 * | 9/2008 | Botts | 215/11.1 |
| 2011/0295197 | A1 * | 12/2011 | Hazan | 604/77 |
| 2013/0030379 | A1 * | 1/2013 | Ingram et al. | 604/218 |
| 2014/0051926 | A1 * | 2/2014 | Oates et al. | 600/109 |

* cited by examiner

*Primary Examiner* — Nicholas Lucchesi
*Assistant Examiner* — Gerald Landry, II
(74) *Attorney, Agent, or Firm* — MacMillan, Sobanski & Todd, LLC

(57) ABSTRACT

A pediatric medicine delivery device includes a syringe and a nipple. The syringe body frictionally engages the inner surface of the nipple with an interference fit. The nipple opening has a diverter for directing fluid in a direction transverse to the axis of the device. A faceplate includes a circumferential orientation device to properly orient the nipple.

20 Claims, 7 Drawing Sheets

FLUID DELIVERY DEVICE

CROSS-REFERENCE TO RELATED APPLICATION

This application claims the benefit of U.S. Provisional Application No. 61/661,647 filed Jun. 19, 2012, the disclosure of which is incorporated herein by reference.

BACKGROUND OF THE INVENTION

This invention relates in general to an apparatus for delivering fluids and more particularly to an apparatus for safely and effectively delivering fluid medication to infants and toddlers.

Infants and toddlers often resist the administering of medicine or refuse to ingest the medicine once administered. A syringe or eyedropper is typically used to administer medicine to infants and toddlers, which are often times sensed as a foreign object. As a result, the infant often will seek to push the object away from or out of its mouth. Even if the infant has adjusted to a syringe or eyedropper, the unfamiliar taste of many medicines will still cause the infant to spit out the medicine once it has been administered.

Syringes and eyedroppers are usually rigid, and in the case of a struggling infant, could possibly be dangerous to the infant's eyes, mouth, and throat. When actually administering the medication if it is injected directly to the back of the throat it often causes a gag reflex. This reflex causes the infant to spit up an unmeasurable amount of the medicine. The important question of proper dosage arises when the medicine has been spilled or spit out by the infant or toddler. It becomes very difficult to estimate or measure how much medicine has been ingested and how much medicine still needs to be given for a proper dosage when the infant refuses a portion of the medicine. There is not only the obvious risk of over dosage, but the risk of under dosage making the medicine ineffective. An under dosage could be as significant as an over dosage if the medicine is critically needed by the infant.

Thus, it would be desirable to provide an improved apparatus for safely and effectively delivering medication in to infants and toddlers.

SUMMARY OF THE INVENTION

This invention relates to an improved apparatus for safely and effectively delivering fluid medication to infants and toddlers. The apparatus includes a tube, which may be part of a syringe, including a fluid reservoir and a downstream opening, and a hollow elastomeric nipple which extends over a part of the tube and over the downstream opening in the tube so that the opening in the tube is generally aligned with the opening in the nipple. Preferably, the tube is frictionally held in place within the nipple with an interference fit. Numerous other features of the invention enhance the safety and effectiveness of the apparatus.

Various aspects of this invention will become apparent to those skilled in the art from the following detailed description of the preferred embodiment, when read in light of the accompanying drawings.

DETAILED DESCRIPTION OF PREFERRED EMBODIMENTS

Figure 1:
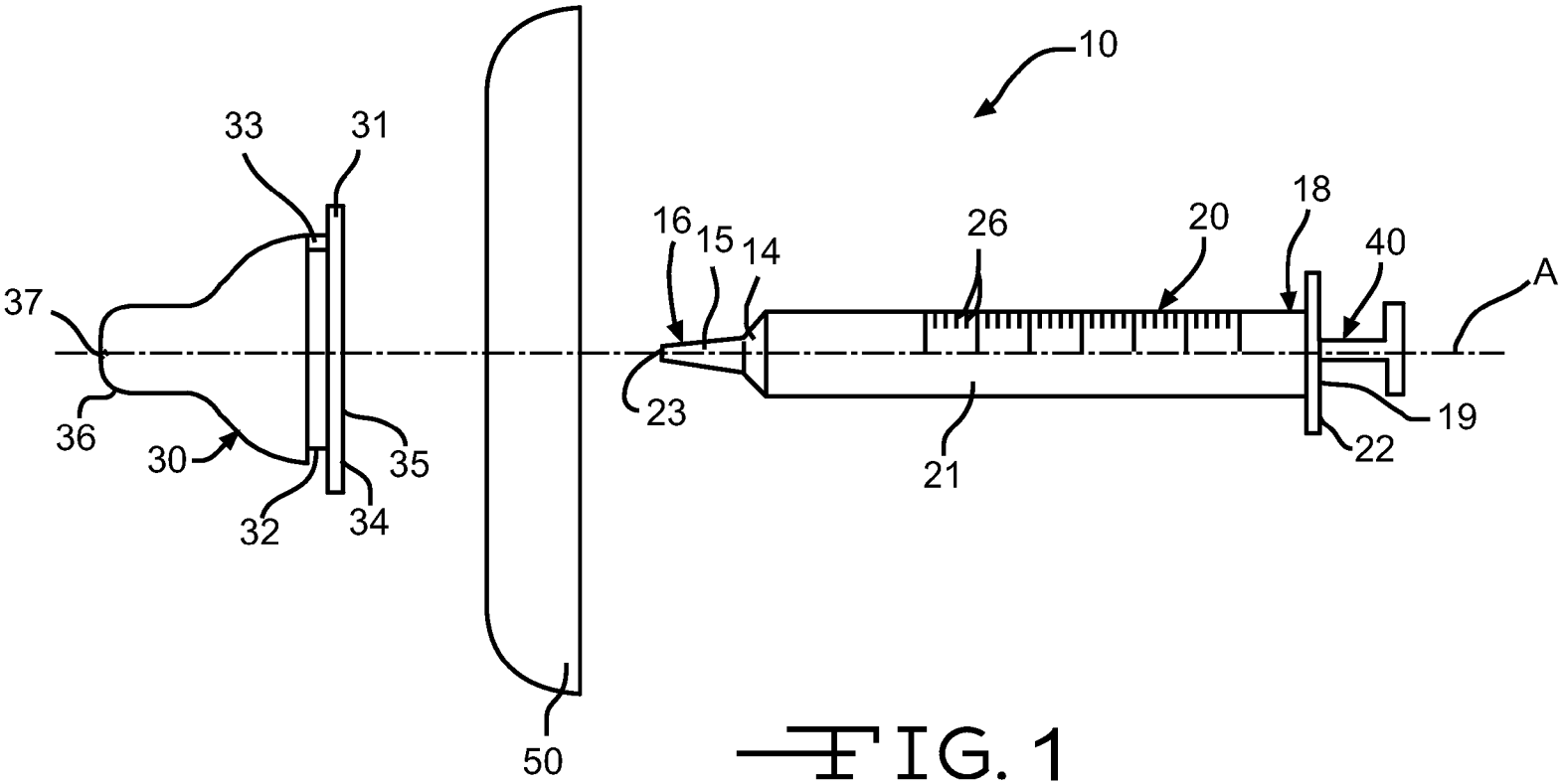
FIG. 1 is an exploded side elevational view of a fluid delivery device in accordance with this invention.

FIG. 1 illustrates a fluid delivery device, specifically a pediatric medicine delivery device, indicated generally at 10, in accordance with this invention. The pediatric medicine delivery device 10 includes a syringe, indicated generally at 20, and a nipple, indicated generally at 30. The syringe 20 includes a body or tube 21 that, in the illustrated embodiment, is generally hollow and cylindrical in shape, defines a fluid reservoir, and is formed from a clear plastic material. However, the tube 21 may be formed having any desired shape and may be formed from any desired material. The pediatric medicine delivery device 10 has a blunt, soft, non-harmful form to allow the safe introduction of medicine should the infant or toddler be moving his or her head rapidly or flailing his or her arms.

The tube 21 extends along a longitudinal directional flow axis A from a first upstream end 18 to a second downstream end 16. The upstream end 18 includes an upstream opening 19 and an optional annular flange 22 provided to facilitate the handling of the pediatric medicine delivery device 10. The downstream end 16 includes stepped frusto-conical outer surface portions 14 and 15 and has a downstream opening or delivery orifice 23. The tapered shape of the downstream end 16 is significant as it relates to the shape of the hollow nipple 30, but other shapes may be used as will be apparent. A plurality of indicia 26 is provided on the outer surface of the tube 21. The indicia 26 provide a visual indication of the amount of fluid that is disposed within the syringe tube 21.

The nipple 30 of the pediatric medicine delivery device 10 includes a mounting flange 31 and an annular groove 32. An integrally molded rib or nib 33 is provided in the groove 32. As will be described in detail below, the mounting flange 31, the groove 32, and the nib 33 are provided to facilitate the connection to and orientation of a faceplate 50. The nipple 30 is preferably formed from a conventional flexible elastomeric material, such as silicone or rubber, although any desired material can be used. The nipple 30 may be provided with one or more differently scented flavors (such as bubble gum, strawberry, and cherry, for example) to mask the taste of some medications and to make it more appealing for infants and toddlers. The scented nipples will help reduce the anxiety of taking medication.

The nipple 30 has an upstream end 34 that includes an upstream opening 35 and a downstream end or tip 36 having a downstream opening or spout 37. Downstream opening 37 is adapted to allow a fluid to flow therethrough when sucked upon by an infant or a toddler or when injected using a syringe. The nipple downstream opening 37 may be a traditional opening such as a pair of slits that are oriented in the shape of an X or any other desired shape to allow for the different types of viscosities found in different medications allowing the infant and toddlers to suck down the medicine. However, a preferred opening configuration will be explained in detail below.

Figure 2:
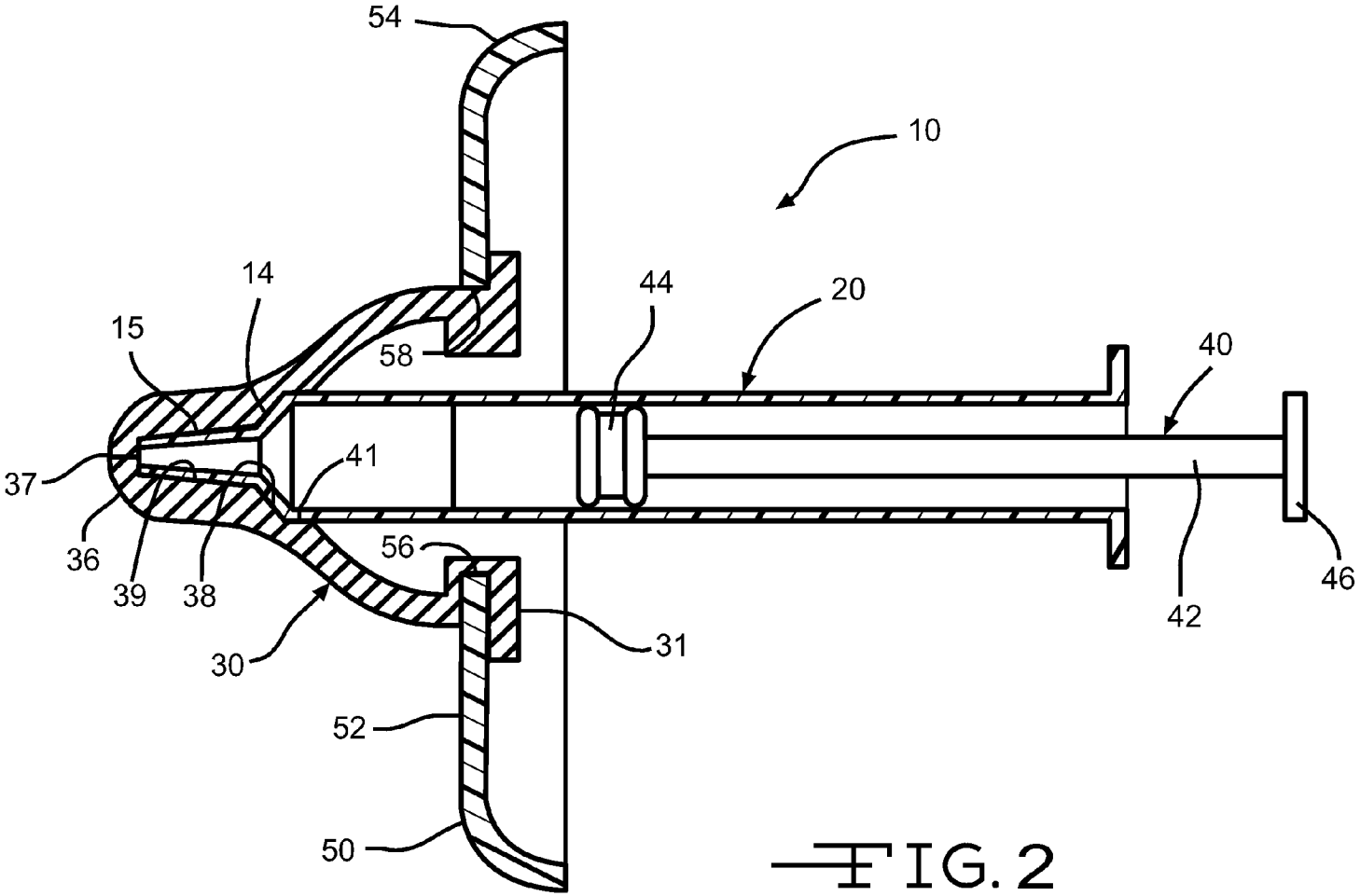
FIG. 2 is a cross-sectional side view of the fluid delivery device of FIG. 1, shown assembled.

Referring to FIG. 2, the syringe 20 includes a plunger 40 that extends into the tube 21 and provides a means for forcing the tube contents through the downstream opening 23. The plunger 40 includes a plastic rod 42 having an integrally formed push plate 46 on one end and an elastomeric piston 44 on the other end, as is well known in the art. Alternatively, an eyedropper-type bulb can be used in place of the plunger.

The nipple 30 is generally hollow, with frusto-conical steps 38 and 39 near the downstream end 36 and generally corresponding frusto-conical steps 14 and 15 of the tube 21. The tube steps 14 and 15 are slightly larger than the steps 38 and 39 to provide a frictional interference fit of the tube 21 within the nipple 30. The elastomeric nature of the nipple 30 allows for a secure but easily removable fit of the tube 21. When so secured, the delivery orifice 23 is disposed within the nipple 32 such that when the nipple 32 is sucked upon by an infant or a toddler, or when injected using a syringe, fluid medicine (not shown) disposed within the tube 21 with be ingested by the infant or toddler. The precise amount of such fluid medicine that is ingested by the infant or toddler can be quickly and easily determined by with reference to the indicia 26 provided on the syringe tube 21.

Referring to FIGS. 1 and 2, the tip of the downstream end 16 of the tube which defines the tube downstream opening 23 is pressed snuggly against the interior surface of the nipple which defines the nipple downstream opening 37. This fit assures that no fluid can be trapped between the tube opening 23 and the nipple opening 37. This feature is particularly important when the fluid being administered is medication to assure that the administered dosage is proper.

Figure 3:
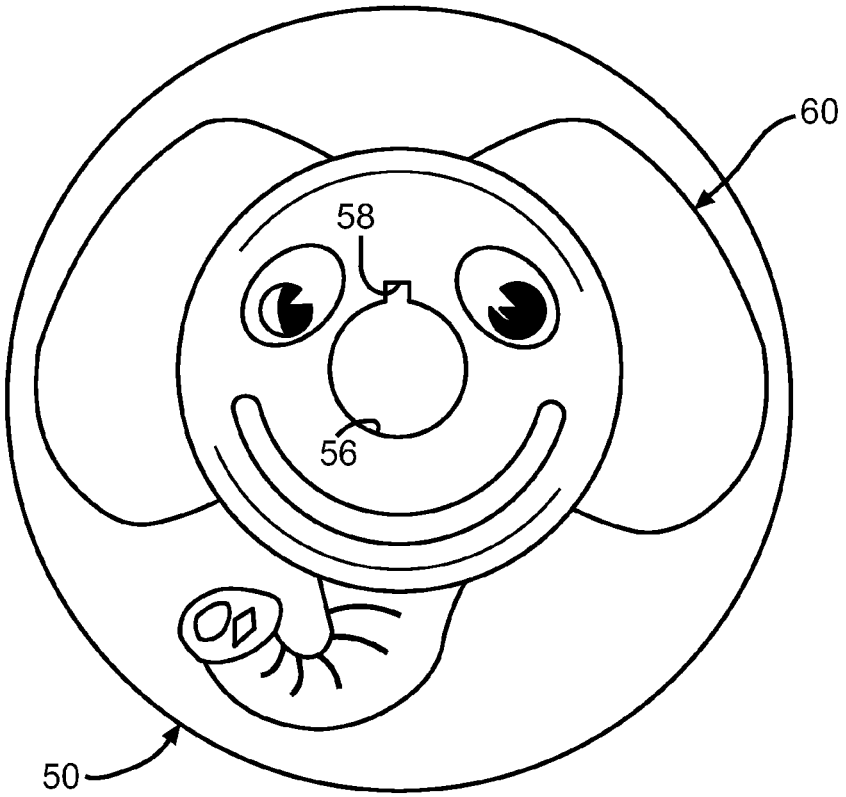
FIG. 3 is an end elevational view of the faceplate of the fluid delivery device of FIGS. 1 and 2.

Referring in addition to FIG. 3, the faceplate 50 is an annular plate having a flat or planar center section 52 for facilitating a connection with the nipple 30 and a rounded or curved outer perimeter 54. Preferably, the faceplate 50 is formed from a flexible plastic material such as polypropylene, but any suitable material may be used. A soft fabric plush toy (not shown) may also be incorporated into the faceplate design. The faceplate 50 has a central aperture 56, which is sized to fit snuggly within the nipple groove 32. The aperture 56 includes a slot 58, which corresponds to the nipple nib 33 and allows the faceplate 50 to be mounted on the nipple 30 in a preferred orientation, as will be explained below.

The faceplate includes a design 60, which assists in proper orientation of the device 10. The design 60 may include animal or toy shapes, etc. to create a more interactive and fun experience for the infant or toddler. The orientation marking of FIG. 3 is an animal face, the proper orientation of which is readily apparent. Of course, the faceplate 50 could have numerous other types of orientation markings, such as a simple depiction of an arrow.

Figure 4:
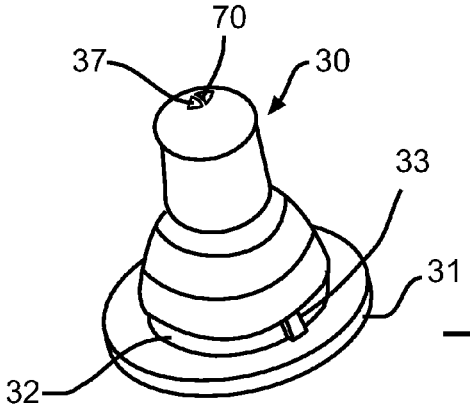
FIG. 4 is a perspective view of the nipple of the fluid delivery device of FIGS. 1 and 2.
Figure 5:
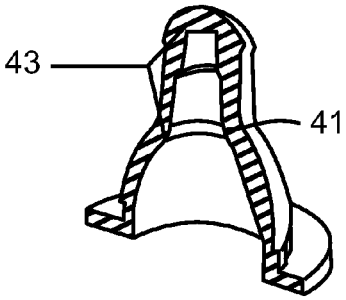
FIG. 5 is a cross-sectional perspective view of the nipple of FIG. 4.

Referring to FIGS. 4 and 5, the nipple nib 33 is positioned in the groove 32 at a specific circumferential position with respect to the nipple downstream opening 37. Of course, non-mechanical orientation devices or methods may also be used. For example, visual alignment markings on the nipple and faceplate could be used. Also, a visual marking on the nipple alone would suffice, although not preferred.

The nipple interior is hollow, with a syringe tube pocket 43 including the frusto-conical surfaces 38 and 39 corresponding to the tube surfaces 14 and 15, and a cylindrical surface 41 corresponding to the outer surface diameter of the tube 21. The syringe pocket 43 is designed to correspond to the interior shape of the nipple 30 to secure the nipple to the syringe tube 21, but an additional benefit is that an infant or toddler can bite down on the nipple without closing the fluid delivery passageway through the tube and impeding fluid flow from the tube 21.

Figure 6:
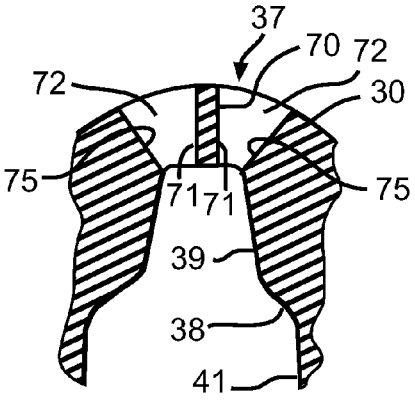
FIG. 6 is a cross-sectional view of the top portion of the nipple of FIGS. 4 and 5.

FIG. 6 more clearly shows the downstream opening 37. The opening 37 includes an integrally molded and centrally positioned fluid diverter 70 that divides the opening 37 into two passageways 72. The diverter 70 has flat parallel side walls 71. Opening 37 is also defined by angularly or transversely extending and generally conically shaped curved walls 75. The diverter 70 cooperates with the walls 75 to direct fluid flowing through the opening 37 in a direction transverse to the longitudinal axis A of the device 10.

The purpose of the design of the spout or opening 37 is to prevent fluid form being forced directly down the throat of a user, which may otherwise occur if the syringe plunger is moved to quickly. The design of opening 37 allows fluid to be directed toward the cheeks of the user rather than directly at the throat. The orientation of the opening 37 is significant for this feature. To this end, the nib 33 is positioned in the groove 32 in alignment with the wall 70. Therefore, if the nib is positioned at the top or bottom of the device as it is inserted into the mouth of the user, the fluid will be deflected toward the cheeks of the user. In any event, in any orientation, the fluid will be deflected away from a path directly into the throat of the user.

Figure 7:
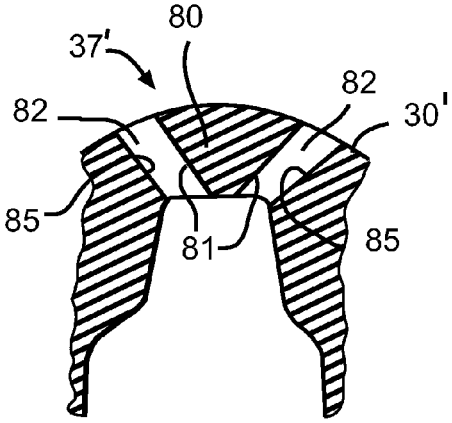
FIG. 7 is a cross-sectional view of the top portion of an alternative nipple design.
Figure 8:
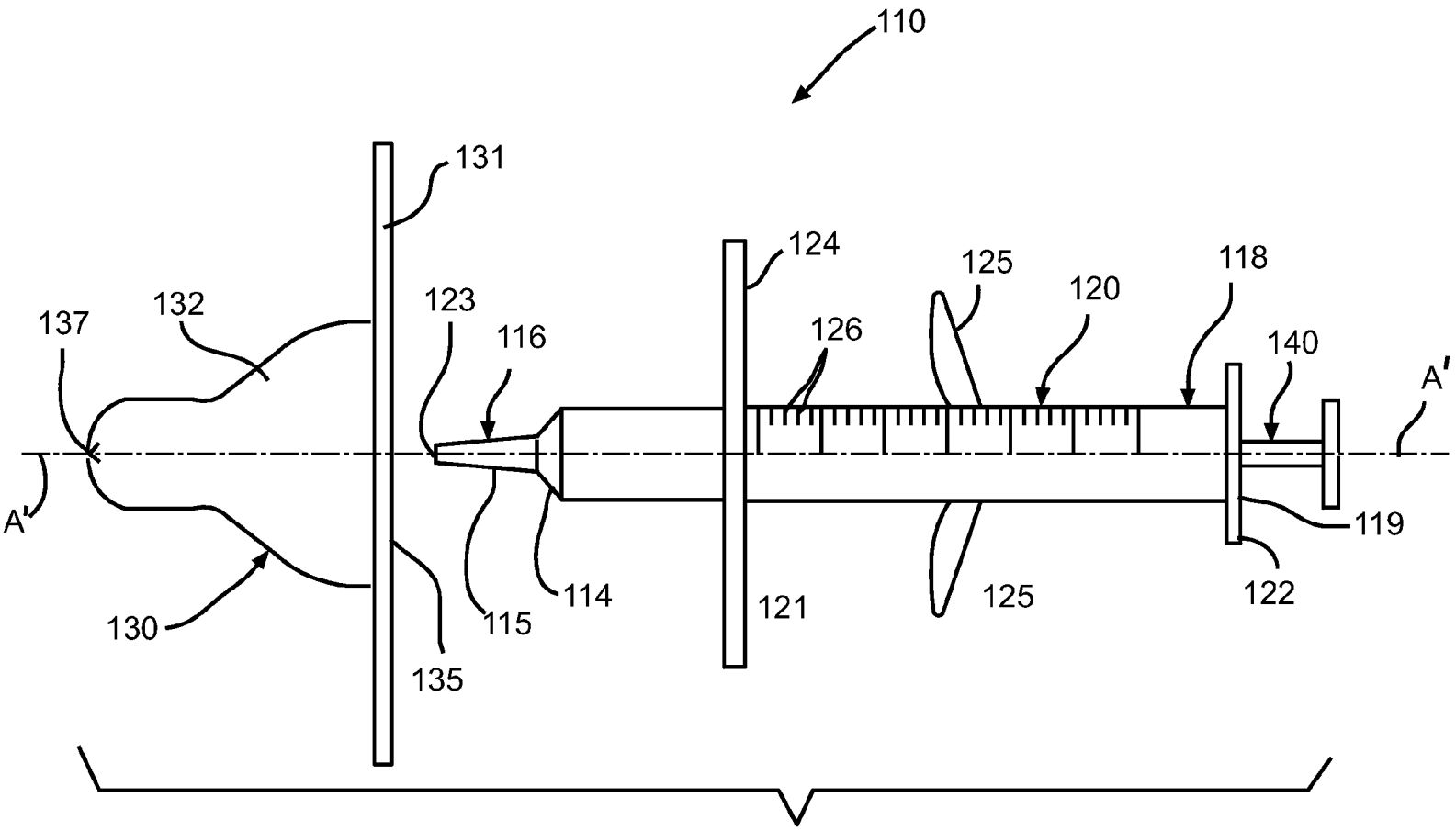
FIG. 8 is an exploded side elevation view of an alternative embodiment of the fluid delivery device in accordance with this invention.
Figure 9:
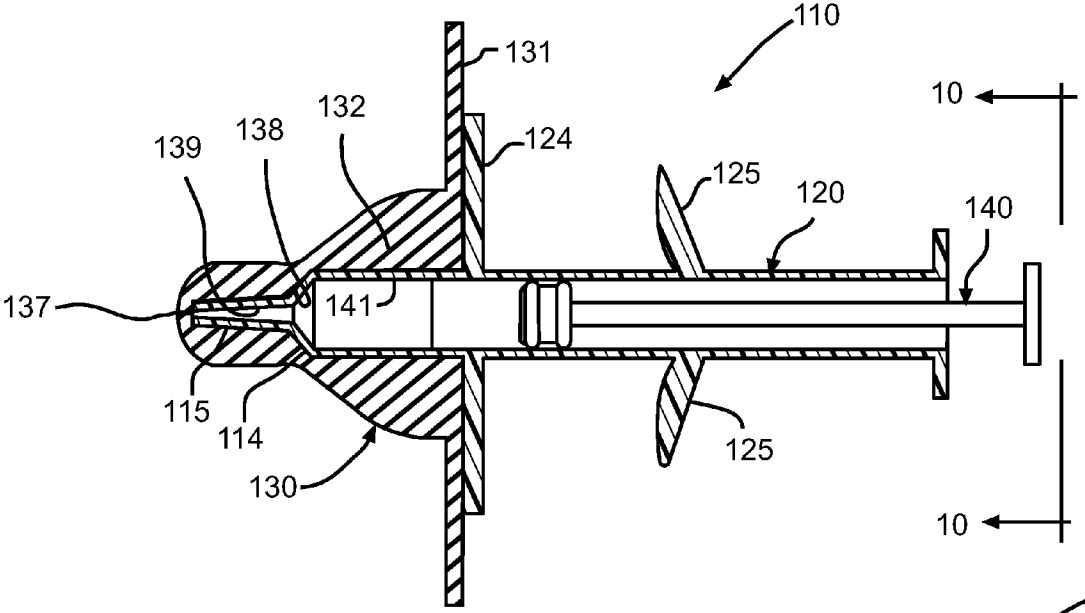
FIG. 9 is a cross-sectional side view of the fluid delivery device of FIG. 8, shown assembled.
Figure 10:
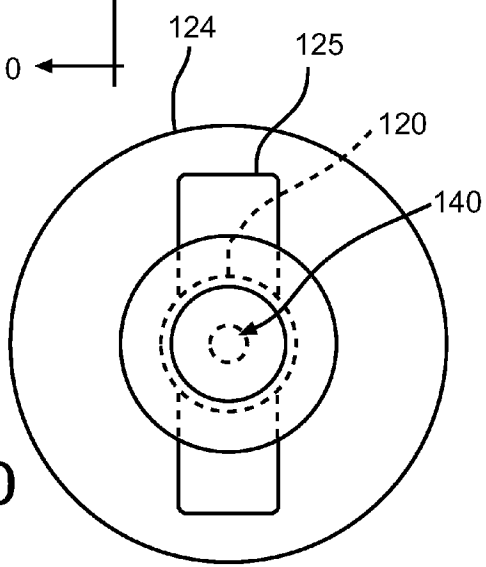
FIG. 10 is an end view of the fluid delivery device of FIG. 9 taken along line 10-10.

FIG. 7 shows an alternative nipple 30' having a downstream opening 37'. The opening 37' includes an integrally molded diverter 80 that divides the opening 37' into two passageways 82. The diverter 80 has side walls 81 which are angled relative to the longitudinal axis A of the device 10. Opening 37' is also defined by angularly or transversely extending curved walls 85. The diverter 80 cooperates with the walls 85 to direct fluid flowing through the opening 37' in a direction transverse to the longitudinal axis A of the device.

FIGS. 8-11 illustrate an alternative embodiment of the present invention. Fluid delivery device 110, includes a syringe 120, and a pacifier 130. The syringe 120 includes a body or tube 121 that is generally hollow and cylindrical in shape and is formed from a clear plastic material. The tube 121 extends along a longitudinal axis A' from a first upstream end 118 to a second downstream end 116. The upstream end 118 includes an upstream opening 119 and an optional annular flange 122 provided to facilitate the handling of the device 110. The downstream end 116 includes stepped frusto-conical outer surface portions 114 and 115 and a downstream opening or delivery orifice 123. A plurality of indicia 126 is provided on the outer surface of the tube 121 between the upstream end 118 and an optional mounting flange 124. Finger flanges 125 are provided on the tube 121 to facilitate handling and use of the device 110. The syringe 120 includes a plunger 140 that is supported on an inner surface 141 of the tube 121.

The pacifier 130 includes a flange 131 and a nipple 132. The flange 131 and nipple 132 are integrally formed by molding. The nipple 132 has an upstream opening 135 and a downstream opening 137. The nipple 130 is generally hollow and has frusto-conical steps 138 and 139 adjacent the downstream end 136 generally corresponding to the frusto-conical steps 114 and 115 of the tube 121. The tube steps 114 and 115 are slightly larger than the steps 138 and 139 to provide a frictional interference fit of the tube 121 within the nipple 130.

Figure 11:
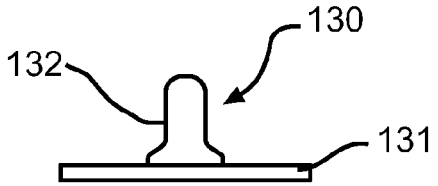
FIG. 11 is a side elevation view of a pacifier of the fluid delivery device of FIGS. 8 and 9.
Figure 12:
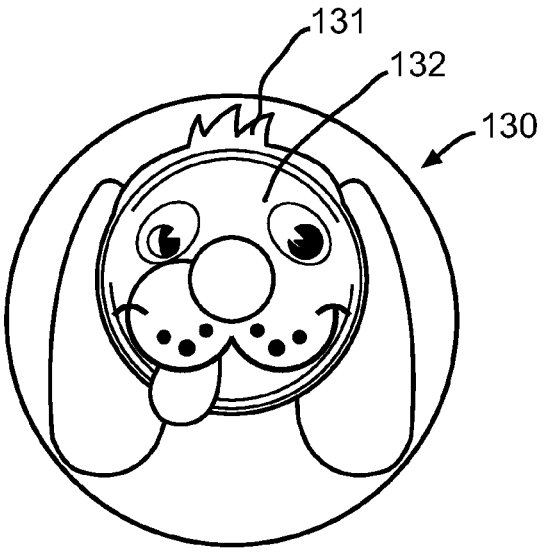
FIG. 12 is a top view of the pacifier of FIG. 11.

FIGS. 11 and 12 illustrate a preferred pacifier 130. The nipple 132 and flange 131 include an orientation device such as an animal picture to facilitate proper orientation of the nipple as previously explained.

Figure 13:
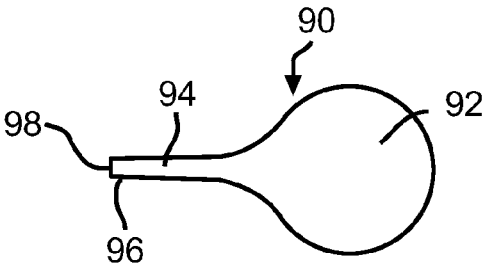
FIG. 13 is a side view of an alternative syringe for use in the fluid delivery device of this invention.

FIG. 13 shows an alternative syringe 90, which is a one piece elastomeric device having a bulb 92 and a spout in the form of a tube 94. The syringe 90 can be used with the delivery device 10 in place of the syringe 20. The syringe 90 has a downstream end 96 that has an opening 98. The outer surface of the downstream end 96 may be inserted into the nipple 30 in a frictional interference engagement with a portion of the inside surface of the nipple, such as frusto-conical surface 39. Of course, many other shapes of the end 96 or the inside surface of the nipple may be used to provide the interference fit. For example, the end 96 could have a stepped frusto-conical shape similar to that of the downstream end of the tube 21.

The pediatric medicine delivery device 10 can be used to allow an infant or toddler to suck out the fluid contents, thereby controlling the fluid flow. Alternatively, the device 10 may be used by a caregiver to control the flow of fluid.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A fluid delivery device comprising:

an axially extending tube having an outer surface, a fluid reservoir, and a downstream opening, a plunger axially movable within the fluid reservoir, and a nipple having a hollow body, an inner surface, and downstream opening, wherein the nipple extends over the tube adjacent the tube opening, and wherein the tube opening is generally axially aligned with the nipple opening, wherein the tube is in contact with and removable from the nipple, and wherein the plunger is extendable within the nipple.

2. A fluid delivery device as defined in claim 1 wherein the opening of the nipple includes a fluid diverter.

3. A fluid delivery device as defined in claim 2 wherein the fluid diverter defines two passageways.

4. A fluid delivery device as defined in claim 3 wherein the fluid diverter has transversely oriented walls defining the two passageways to divert fluid passing through the opening in transverse directions.

5. A fluid delivery device as defined in claim 1 wherein the tube is part of a syringe that includes the plunger, the plunger including a piston.

6. A fluid delivery device as defined in claim 1 wherein the tube is frictionally engaged with the inner surface of the nipple in an interference fit.

7. A fluid delivery device as defined in claim 6 wherein the tube includes a frusto-conical portion in mating engagement with a corresponding frusto-conical portion on the inner surface of the nipple.

8. A fluid delivery device as defined in claim 1 wherein a portion of the fluid reservoir of the tube extends into the hollow nipple body.

9. A fluid delivery device as defined in claim 1 further comprising a faceplate adjacent the nipple.

10. A fluid delivery device as defined in claim 2 further comprising a faceplate adjacent the nipple, wherein the faceplate includes a circumferential orientation marking.

11. A fluid delivery device as defined in claim 10 further including a circumferential alignment device for aligning the nipple and the faceplate.

12. A fluid delivery device as defined in claim 2 wherein the nipple includes a circumferential orientation marking.

13. A fluid delivery device as defined in claim 1 wherein the nipple includes a hollow body, an upstream opening, the downstream opening including a fluid diverter, the fluid diverter comprising a planar wall extending transversely to a directional flow axis defined by the nipple.

14. A fluid delivery device as defined in claim 13 wherein the downstream opening further includes a second planar wall, wherein the planar walls define two passageways.

15. A fluid delivery device as defined in claim 14 wherein the downstream opening has a generally conically shaped wall, wherein the two axially extending passageways are defined by a planar wall and a portion of the generally conically shaped wall.

16. A method of orally delivering fluid to a first human by a second human, the method comprising the steps of:

providing an axially extending tube having a fluid reservoir and a downstream opening, providing a syringe having a plunger axially movable within the fluid reservoir of the tube, and providing an axially extending nipple having a hollow body, a downstream end, and a fluid delivery opening in the downstream end, the nipple extending over the tube adjacent the downstream opening in the tube, the fluid delivery opening having a transversely extending wall extending completely across the opening to divide the delivery opening into two distinct fluid passageways, inserting the downstream end of the nipple into the mouth of the first human and, forcing the fluid through the delivery opening by a second human by moving the plunger axially within the fluid reservoir toward the downstream opening of the tube and the field delivery opening of the nipple, whereby the fluid is diverted by transversely extending wall in a direction transverse to the nipple axis.

17. The method of claim 16 further comprising the step of providing the syringe in engagement with the nipple to allow the second human to force the fluid through the delivery opening, and providing the nipple opening with a frusto-conical outer wall, whereby each of the two fluid passageways is defined by the transversely extending wall and a portion of the frusto-conical outer wall.

18. The method of claim 17 further comprising the step of providing an orientation device on the nipple.

19. The method of claim 18 further comprising the step of aligning the transversely extending wall of the delivery opening toward a cheek of the first human prior to forcing the fluid through the delivery opening.

20. A fluid delivery device as defined in claim 14 wherein the first and second planar walls are generally parallel to each other.

* * * * *